United States Patent [19]

Butler

[11] 4,307,976

[45] Dec. 29, 1981

[54] LOCKING GUTTER SCREEN HINGE

[75] Inventor: Alan W. Butler, Doraville, Ga.

[73] Assignee: Gutter World, Inc., Doraville, Ga.

[21] Appl. No.: 150,801

[22] Filed: May 19, 1980

[51] Int. Cl.[3] ..... E02B 5/00; E04D 13/08

[52] U.S. Cl. ..... 405/118; 52/11

[58] Field of Search ..... 16/128 R, 172, 180, 16/190; 52/11, 12, 16, 684, 712, 715; 405/118–122; 210/474, 475; 403/188, 187; 248/229; 24/81 B

[56] References Cited

U.S. PATENT DOCUMENTS 2,636,458 4/1953 Harris ..... 52/12 X
2,810,173 10/1957 Bearden ..... 24/81 B
3,351,206 11/1967 Wennerstrom ..... 52/12 X
3,921,253 11/1975 Nelson ..... 16/172

*Primary Examiner*—Price C. Faw, Jr.
*Assistant Examiner*—Nancy J. Pistel
*Attorney, Agent, or Firm*—James B. Middleton

[57] ABSTRACT

A gutter screen hinge with a lock is disclosed. The hinge includes a clip to engage the edge of a gutter, and the clip carries one or more hinge loops to receive a wire of the gutter screen for hinging the screen. A finger extends from the clip, the finger having a hook at its end to engage a wire of the screen. The hook engages the screen at a point spaced from the hinge axis, thereby preventing hinging of the screen. The hook and screen are movable relative to each other to release the screen.

8 Claims, 6 Drawing Figures

LOCKING GUTTER SCREEN HINGE

FIELD OF THE INVENTION

This invention relates generally to hinged gutter screens, and is more particularly concerned with a hinge arrangement having means for locking the screen in position over the gutter.

BACKGROUND OF THE INVENTION

For many years gutters have been provided with screens or guards to prevent leaves and other debris from falling into the gutter. Though the screens successfully exclude a great majority of the debris, it is still necessary to have access to the interior of the gutter for cleaning and other purposes. For easy access, gutter screens have been provided with hinges to allow the screen to be pivoted away from the gutter, and to allow the screens to be easily replaced.

The difficulty with hinged gutter screens is that the screens are sometimes inadvertently caused to pivot to the open position so that the screens do not protect the gutter. The inadvertent, or unintentional, opening of the screen has various causes, including such things as limbs sliding down a roof, strong winds, and small animals such as birds, squirrels and like. As a result, the source of the problem is not truly controllable.

The prior art hinged gutter screens have included gutter screens that are hinged from the edge of the gutter adjacent to the eave so the screens will tend to stay closed, but elaborate structure is required to support such a screen since one would generally not place nails or screws into the roof itself. The prior art also includes hinged gutter screens having spring means to bias the screen to a closed position. While a sufficiently strong spring may prevent the inadvertent opening of a gutter screen, such an arrangement would render the intentional opening extremely difficult since the screen must be held at all times to prevent the unintentional closing of the screen. Also, the addition of springs and like to a hinge renders the arrangement unduly complex and significantly raises the cost of the hinge.

SUMMARY OF THE INVENTION

The present invention overcomes the above mentioned and other difficulties with the prior art by providing an extremely simple hinge for a gutter screen, the hinge having hook means carried thereby for engaging the screen at a point spaced from the hinge axis of the screen. Means are also provided for disengagement of the hook means from the screen so that the screen can be pivoted about the hinge axis. In more detail, the hinge made in accordance with the present invention includes a clip carrying loops for engaging a wire of the gutter screen to provide for pivoting of the gutter screen, the clip further including a finger extending therefrom for selectively engaging a second wire of the screen spaced from the first wire, or hinge wire, of the screen. In one embodiment of the invention, means are provided for shifting the screen itself for disengagement of the hook means, and in another embodiment of the invention the hook means is selectively movable to disengage the screen.

BRIEF DESCRIPTION OF THE DRAWINGS

These and other features and advantages of the present invention will become apparent from consideration of the following specification when taken in conjunction with the accompanying drawings in which.

DESCRIPTION OF THE PREFERRED EMBODIMENTS

Figure 1:
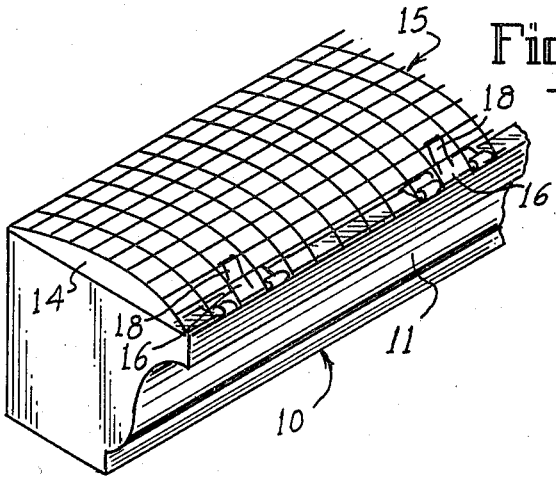
FIG. 1 is a perspective view of a section of a gutter having a screen thereon, and including a pair of hinges made in accordance with the present invention.

Referring now to more particularly to the drawings, and to those embodiments of the invention here chosen by way of illustration, of FIG. 1 discloses a portion of a gutter 10 having a front 11 which terminates in an inwardly extending flange 12. The open top 14 of the gutter 10 is closed by screen 15, the screen 15 being preferably of an arcuate configuration.

A plurality of hinges 16 conventionally fixes the screen 15 to the flange 12 of the gutter 10; and, FIG. 1 further discloses a finger 18 for locking the gutter screen 15 in its closed position.

Figure 2:
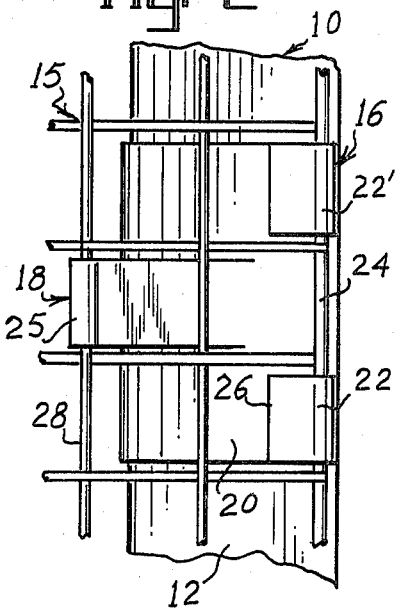
FIG. 2 is an enlarged top plan view of one of the hinges shown in FIG. 1.
Figure 3:
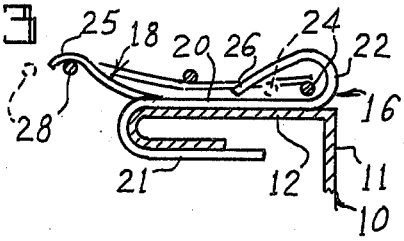
FIG. 3 is a cross-sectional view taken substantially along the line 3—3 in FIG. 2.
Figure 4:
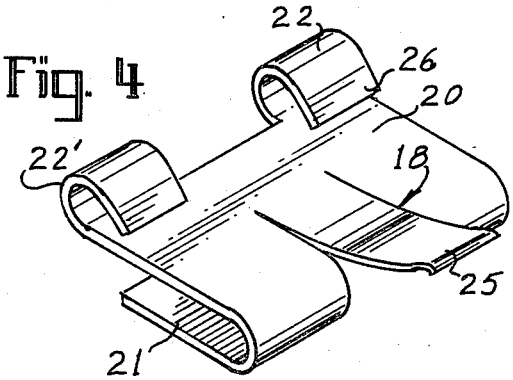
FIG. 4 is a perspective view showing the hinge member disclosed in FIGS. 1, 2 and 3.

Referring now to FIGS. 2, 3 and 4 for a more detailed description of the present invention, it will be seen that the hinge 16 includes a base 20 having a return bend 21 for providing a clip arrangement to engage the flange 12 of the gutter 10. As here shown, the flange 12 of the gutter 10 also has a return bend, or hem, so the clip has a sufficiently wide open space to engage this particular flange 12. It will of course be obvious to those skilled in the art that if the hem were flattened, or if the flange 12 comprised simply a raw edge, the clip would be equally narrow for frictionally engaging the flange 12.

At one edge of the base 20, there is a hinge loop 22 for receiving the edge wire 24 of the screen 15. As here shown, primarily in FIG. 3 of the drawings, the loop 22 is somewhat elongated so that the wire 24 can move from the position shown in full lines to the position shown in broken lines. This will be discussed in more detail hereinafter. It will also be seen that, in the embodiments here presented, the hinge 16 includes a pair of the loops 22, the second loop being indicated at 22'.

Between the hinge loops 22 and 22', and extending from the base 20 in the opposite direction therefrom, there is a finger 18. It will be seen that the finger 18 extends from the base 20 generally in the same plane as the base, and terminates in a hook 24 which is above the plane of the base 20.

It will be seen from the drawings that the hinge 16 here presented is formed from a single piece of metal, the metal being removed between the loops 22 and 22', to provide the space therebetween. It will of course be understood, however, that the device may be made with one continuous loop 22 extending completely across the base 20 in the event the screen 15 has sufficiently wide mesh, or if one wish to remove appropriate wires to provide sufficiently large openings. Also, as here shown, the finger 18 is struck from the body of the material. While such a technique conserves metal, and obviates the need for later assembly, it should be obvious that the finger 18 may be spot-welded or otherwise affixed to the base 20 if desired.

Looking now primarily at FIGS. 2 and 3 of the drawings, it should be understood from the foregoing description that the hinge loops 22 can be formed with the end 26 spaced from the base 20. In this condition, the wire 24 which is to serve as the hinge wire, or pintle, can be passed between the end 26 and the base 20 to be received within the loop 22. When the wire 24 is in place, the loop 22 can be bent so that the end 26 substantially touches the base 20 to prevent removal of the wire 24.

When the wire 24 of the screen 15 is urged forward in the loop 22, or to the right as viewed in the drawings, another wire 28 will be engageable with the hook 25 on the finger 18. Since the wire 24 comprises the pintle, or hinge pin, for the screen 15, it will be understood that the screen 15 is prevented from pivoting by the holding of the wire 28 which is spaced from the wire 24. It will also be understood that the hook 25 is so positioned that the screen 15 will exert an upward force at the hook 25 so that the wire 28 will be held snugly within the hook 25.

When it is desired to pivot the screen 15, one can depress the wire 28 slightly and/or pull the hook 25 up slightly to separate the wire 28 from the hook 25. Then, the screen 15 can be moved rearwardly, or to the left as viewed in the drawings, so that the wire 28 takes the broken-line position which is beyond the hook 25, and the wire 24 assumes the broken-line position at the rear of the elongated hinge loop 22. In this position, the screen 15 can be pivoted, the screen 15 moving about the wire 24 as a hinge axis.

Figure 5:
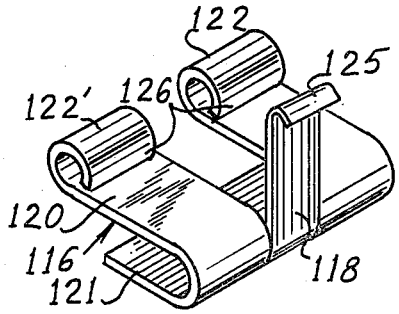
FIG. 5 is a view similar to FIG. 4 showing a modified form of hinge member made in accordance with the present invention; and, FIG. 6 is a view similar to FIG. 3 but showing the hinge member disclosed in FIG. 5 of the drawings.
Figure 6:
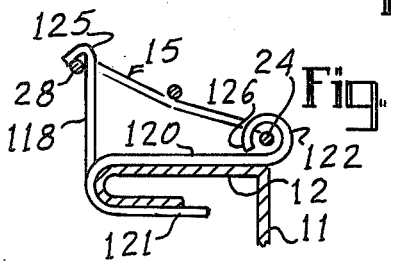

Looking now at FIGS. 5 and 6 of the drawings, it will be seen that the embodiment of the invention here presented is similar to the previously described embodiment, this device including a base 120 and hinge loops 122 and 122'. The metal from which the base 120 is made is bent to provide the return bend 121 to make a clip as previously described. The primary difference between the embodiment of the invention shown in FIGS. 5 and 6 and the previously described embodiment is the arrangement of the finger 118 with its hook 125. In FIGS. 5 and 6 it will be seen that the finger 118 is a generally upstanding finger struck from the base 120, extending generally perpendicularly to the plane of the base 120 and terminating in the hook 125. As before, it will be readily understood that the finger 118 may be spot-welded or otherwise affixed to the hinge 116, though the arrangement shown wherein the entire hinge 116 is formed from a single piece of metal is both economical and efficient in manufacture.

Looking primarily at FIG. 6 of the drawings for a description of the operation of the second embodiment of the hinge of the present invention, it will be seen that the clip fits over the flange 12 as previously described. The hinge loop 122 is substantially circular in configuration, being designed to surround the edge wire 24 to provide the hinging effect. As before, the loop 122 can be left somewhat open with the end 126 spaced from the base 120 until the hinge 116 has been installed on a screen 15.

The finger 118 extends upwardly from the rear edge of the hinge 116, and the hook 125 engages a wire 28 spaced from the wire 24. It will be seen that the screen 15 cannot easily move with respect to the hinge 116; however, in this embodiment of the invention the finger 118 is somewhat resilient so the finger can be moved forwardly. Thus, the screen 15 can be depressed to remove the wire 28 from the hook 125, then the finger 118 could be moved forwardly to avoid the wire 28 and allow the screen 15 to be pivoted about the wire 24.

It will therefore be seen that the present invention provides a locking hinge for a gutter screen, the hinge being extremely simple in construction and economical to manufacture. The hinge does not require numerous parts, but may be integrally formed for easy and secure installation and operation.

Due to the construction of the hinge of the present invention it will be understood that the hinge acts also as a fastener to fix the gutter screen to the gutter; and, because of the simple clip arrangement, the screen is removable from and replaceable on the gutter at will. Thus, the device of the present invention allows a screen to be locked in position over the gutter, allows the screen to remain attached to the gutter but pivoted for access to the interior of the gutter, allows the screen to be completely removed from the gutter, and allows the same screen to be replaced on the gutter using the same hinges.

While the embodiments of the invention as shown have the hook engaging a wire parallel to the hinge pintle, it will also be understood that the hook can reach to the side to engage a wire transverse to the pintle.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as defined in the appended claims.

I claim:

1. A gutter screen hinge for pivotally fixing a screen over the open top of a gutter, said hinge including a clip for fixing said hinge to said gutter, at least one hinge loop carried by said clip for receiving a first wire of said screen, said first wire constituting a pintle for said screen hinge, a finger extending from said clip, hook means at the extending end of said finger for receiving a second wire of said screen, said hook means being spaced from said pintle, said gutter including an inwardly turned flange, said clip being receivable on said flange, said clip including a base lying on said flange, said hinge loop being carried at one edge of said base, said finger extending from the opposite edge of said base.

2. A gutter screen hinge as claimed in claim 1, said finger extending generally parallel to said base, said hook being positioned slightly above the plane of said base.

3. A gutter screen hinge as claimed in claim 2, said first wire extending generally parallel to said flange, said hinge loop being elongated to allow lateral motion of said first wire, said second wire being generally parallel to said first wire, said lateral motion being sufficient to remove said second wire from said hook.

4. A gutter screen hinge as claimed in claim 1, said finger extending generally perpendicularly to said base for engaging a wire above said base.

5. A gutter screen hinge as claimed in claim 4, said first wire extending generally parallel to said flange, said finger being resiliently movable for disengaging said hook from said second wire.

6. A gutter screen hinge as claimed in claim 1, said hinge being formed of a single piece of material, said hinge loop being formed at one edge of said base, a return bend extending from said base for forming said clip, said finger being struck from said clip for extending therefrom.

7. A gutter screen hinge as claimed in claim 6, said finger being struck from said return bend and extending generally in the plane of said base.

8. A gutter screen hinge as claimed in claim 6, said finger being struck from said base and extending generally perpendicularly to the plane of said base.

* * * * *